US012624422B2

(12) United States Patent
Arayama et al.

(10) Patent No.: US 12,624,422 B2
(45) Date of Patent: May 12, 2026

(54) ALUMINUM ALLOY FORGING AND MANUFACTURING METHOD THEREOF

(71) Applicant: Resonac Corporation, Tokyo (JP)

(72) Inventors: Takuya Arayama, Tokyo (JP); Hiroaki Murakami, Tokyo (JP); Yoshifumi Kimura, Tokyo (JP)

(73) Assignee: Resonac Corporation, Tokyo (JP)

( * ) Notice: Subject to any disclaimer, the term of this patent is extended or adjusted under 35 U.S.C. 154(b) by 353 days.

(21) Appl. No.: 18/269,386

(22) PCT Filed: Dec. 8, 2022

(86) PCT No.: PCT/JP2022/045362
§ 371 (c)(1),
(2) Date: Jun. 23, 2023

(87) PCT Pub. No.: WO2023/139960
PCT Pub. Date: Jul. 27, 2023

(65) Prior Publication Data

US 2024/0417828 A1 Dec. 19, 2024

(30) Foreign Application Priority Data

Jan. 18, 2022 (JP) ..... 2022-005676

(51) Int. Cl.
*C22C 21/02* (2006.01)
*B22D 11/00* (2006.01)
*B22D 25/06* (2006.01)

(52) U.S. Cl.
CPC ..... *C22C 21/02* (2013.01); *B22D 11/003* (2013.01); *B22D 25/06* (2013.01)

(58) Field of Classification Search
CPC . C22C 21/02; C22C 21/08; C22F 1/05; C22F 1/043; C22F 1/047; B22D 11/003; B22D 25/06
See application file for complete search history.

(56) References Cited

U.S. PATENT DOCUMENTS

| | | | | |
|---|---|---|---|---|
| 2010/0089503 | A1* | 4/2010 | Inagaki | C22C 21/08 148/552 |
| 2010/0123123 | A1 | 5/2010 | Li et al. | |
| 2013/0032255 | A1* | 2/2013 | Hori | C22F 1/05 148/552 |
| 2021/0123123 | A1 | 4/2021 | Arayama | |
| 2021/0301383 | A1 | 9/2021 | Arayama | |

FOREIGN PATENT DOCUMENTS

| | | | |
|---|---|---|---|
| CN | 101365818 | A | 2/2009 |
| CN | 101855375 | A | 10/2010 |
| CN | 110952000 | A | 4/2020 |
| JP | 05-059477 | A | 3/1993 |
| JP | 05-247574 | A | 9/1993 |
| JP | 06-256880 | A | 9/1994 |
| JP | 2000-144296 | A | 5/2000 |
| JP | 2007-009273 | A | 1/2007 |
| JP | 2008-163445 | A | 7/2008 |
| JP | 2011-214093 | A | 10/2011 |
| JP | 2021-095590 | A | 6/2021 |
| JP | 2021-143375 | A | 9/2021 |

OTHER PUBLICATIONS

Yi, X. U., Yi Han, and Hiromi Nagaumi. "Near net shape casting process for producing high strength 6xxx aluminum alloy automobile suspension parts." Transactions of Nonferrous Metals Society of China 24.7 (2014): 2393-2400.*

* cited by examiner

*Primary Examiner* — Jessee R Roe
(74) *Attorney, Agent, or Firm* — Sughrue Mion, PLLC

(57) ABSTRACT

An aluminum alloy forging formed of an aluminum alloy containing Cu: 0.15% to 1.0%, Mg: 0.6% to 1.35%, Si: 0.95% to 1.45%, Mn: 0.4% to 0.6%, Fe: 0.2% to 0.7%, Cr: 0.05% to 0.35%, Ti: 0.012% to 0.035%, B: 0.0001% to 0.03%, Zn: 0.25% or less, Zr: 0.05% or less (all % given by mass), and a remainder consisting of Al and inevitable impurities, in which a crystal grain diameter where a maximum principal stress is applied is 20 to 40 μm. The aluminum alloy forging has a structure in which an average shortest distance from a precipitate having a major axis of 0.1 μm or more to a crystal grain boundary in a cross-sectional structure with a visual field area of 8,000 $\mu m^2$ is in a range of 0.1 μm to 2.0 μm, and a fatigue life at a load stress of 150 MPa is $6\times10^6$.

1 Claim, 3 Drawing Sheets

ALUMINUM ALLOY FORGING AND MANUFACTURING METHOD THEREOF

CROSS REFERENCE TO RELATED APPLICATIONS

This application is a National Stage of International Application No. PCT/JP2022/045362 filed Dec. 8, 2022, claiming priority based on Japanese Patent Application No. 2022-005676 filed Jan. 18, 2022, the respective contents of which are incorporated herein by reference in their entireties.

TECHNICAL FIELD

The present invention relates to an aluminum alloy forging and a manufacturing method thereof.

BACKGROUND ART

In recent years, aluminum alloys have had wide applications as structural members of various products due to their lightness. For example, for automobile suspension and bumper parts, high-tensile strength steel has been used. Meanwhile, high-strength aluminum alloy materials have been used in recent years.

In addition, iron-based materials have been exclusively used for auto parts, especially suspension parts. Meanwhile, in recent years, the iron-based materials have been replaced by aluminum materials or aluminum alloy materials in many cases with primary purpose of weight reduction.

Since these auto parts require excellent corrosion resistance, high strength, and excellent workability, Al—Mg—Si-based alloys, especially A6061, are frequently used as aluminum alloy materials. In order to improve the strength, such auto parts are manufactured by forging, which is one type of plastic working, using an aluminum alloy material as a working material.

In addition, recently, suspension parts obtained by forging a cast member as a raw material without extruding and then subjecting it to a solutionizing treatment and an artificial aging treatment (T6 treatment) have started to be put to practical use due to the need to reduce costs, and development of high-strength alloys which will replace A6061 of the related art has continued in order to further reduce the weight (For example, see Patent Documents 1 to 3).

CITATION LIST

Patent Documents

[Patent Document 1]
Japanese Unexamined Patent Application, First Publication No. H5-059477
[Patent Document 2]
Japanese Unexamined Patent Application, First Publication No. H5-247574
[Patent Document 3]
Japanese Unexamined Patent Application, First Publication No. H6-256880

SUMMARY OF INVENTION

Technical Problem

In recent years, from the viewpoint of reducing $CO_2$ emissions, there has been demand for lighter automobiles, and demand for aluminum is on the rise. However, a substitute for ferrous materials is required to be further increased in strength. Meanwhile, as one method for increasing the strength, suppressing the formation of a recrystallized structure and refining crystal grain diameters in plastic working and a solutionizing treatment step have been known.

However, the Al—Mg—Si-based high-strength alloys described above have a problem in that it is not possible to obtain a sufficiently high strength due to the recrystallization of the worked structure and the generation of coarse crystal grains in the forging and heat treatment step. Therefore, in order to prevent the formation of coarse recrystallized grains, Zr is added to prevent recrystallization (for example, see Patent Documents 1 and 2).

However, the addition of Zr is effective in preventing recrystallization, but has the following problems.

(1) Due to the addition of Zr, the crystal grain refining effect of an Al—Ti—B-based alloy is reduced, and the crystal grains of an ingot itself are made coarse. This leads to a reduction in strength of a worked product (forging) after plastic working.

(2) Since the crystal grain refining effect of the ingot itself is reduced, ingot cracks are likely to occur, internal defects increase, and the yield deteriorates.

(3) Zr forms compounds with an Al—Ti—B-based alloy, and the compounds are deposited on a bottom of a furnace where a molten alloy is stored, and contaminates the furnace. The compounds are coarsely crystallized also in a manufactured ingot, and cause a reduction in strength.

As described above, the addition of Zr is effective in preventing recrystallization, but it has been difficult to maintain strength stability.

One aspect of the present invention is contrived in view of such technical background, and one object thereof is to provide an aluminum alloy forging having excellent fatigue characteristics at room temperature and a manufacturing method thereof.

Solution to Problem

One aspect of the present invention provides the following means in order to solve the problems.

(1) An aluminum alloy forging formed of an aluminum alloy containing: Cu:
0.15% by mass to 1.0% by mass;
Mg: 0.6% by mass to 1.35% by mass;
Si: 0.95% by mass to 1.45% by mass;
Mn: 0.4% by mass to 0.6% by mass;
Fe: 0.2% by mass to 0.7% by mass;
Cr: 0.05% by mass to 0.35% by mass;
Ti: 0.012% by mass to 0.035% by mass;
B: 0.0001% by mass to 0.03% by mass;
Zn: 0.25% by mass or less;
Zr: 0.05% by mass or less; and
a remainder consisting of Al and inevitable impurities,
in which a crystal grain diameter in a part of the aluminum alloy forging where a maximum principal stress is applied to the part is 20 to 40 μm,
the aluminum alloy forging has a structure in which an average shortest distance from a precipitate having a major axis of 0.1 μm or more to a crystal grain boundary in a cross-sectional structure with a visual field area of 8,000 $\mu m^2$ is in a range of 0.1 μm or more and 2.0 μm or less, and the aluminum alloy forging has fatigue characteristics in which a fatigue life at a load stress of 150 MPa is $6\times10^6$ or more at room temperature.

(2) A manufacturing method of the aluminum alloy forging according to (1), including:

preparing a molten alloy having the same composition as the aluminum alloy forging; and casting the molten alloy at a cooling speed of 100 to 140° C./sec during casting so that a crystal grain diameter is 110 μm or less in a metallographic structure of an obtained cast rod.

Advantageous Effects of Invention

According to one aspect of the present invention, it is possible to provide an aluminum alloy forging having excellent fatigue characteristics at room temperature and a manufacturing method thereof.

DESCRIPTION OF EMBODIMENTS

Figure 1:
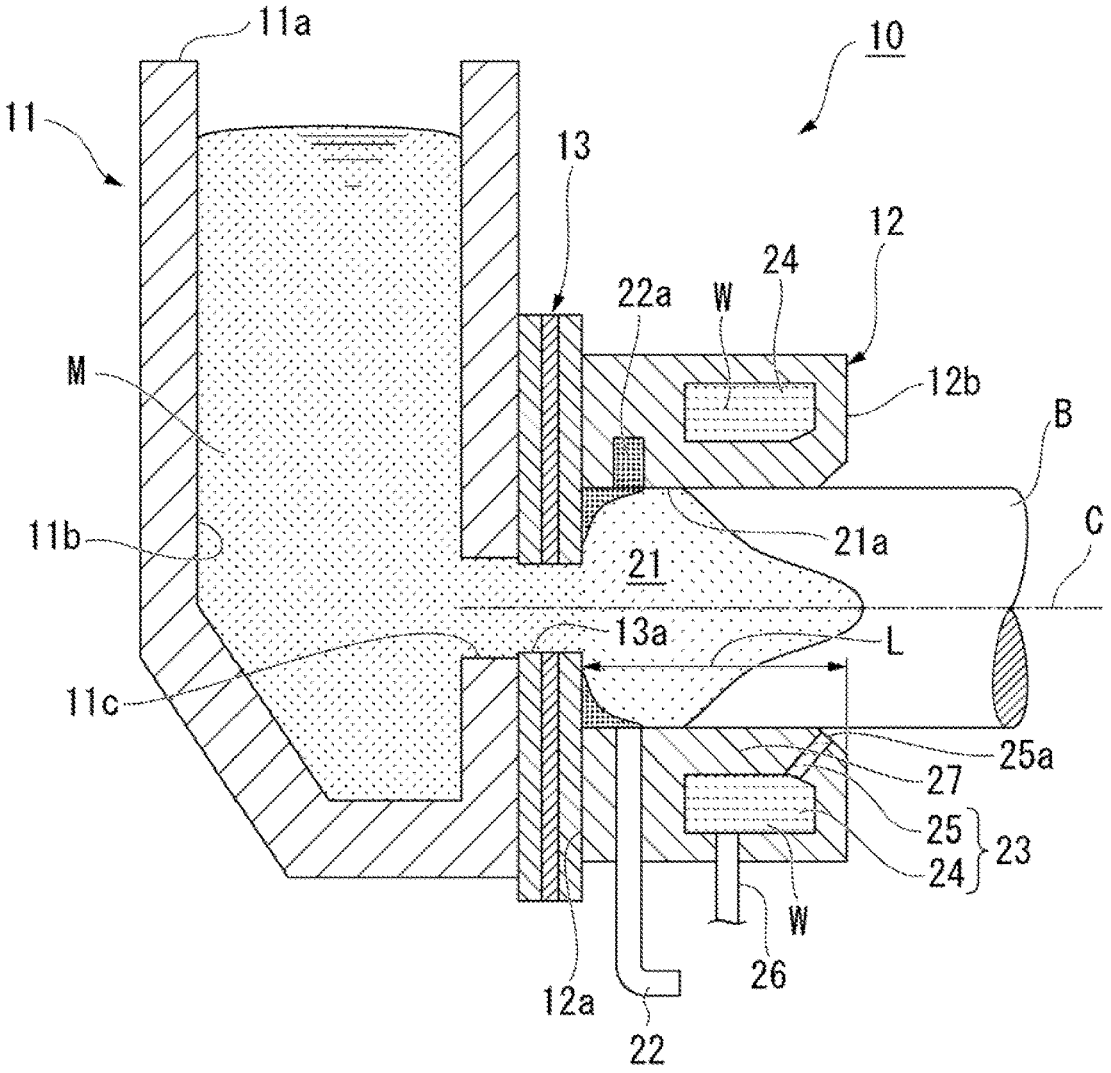
FIG. 1 is a cross-sectional view showing an example of the vicinity of a mold of a horizontal continuous casting apparatus for manufacturing an aluminum alloy casting according to an embodiment of the present invention.

Hereinafter, embodiments of the present invention will be described in detail with reference to the drawings.

In the drawings used in the following description, characteristic parts may be shown in an enlarged manner for the sake of convenience in order to make the characteristics easier to understand, and dimensional ratios of the constituent elements may not necessarily be the same as actual ratios. The materials, dimensions, and the like provided in the following description are merely an exemplary example. The present invention is not necessarily limited thereto, and can be appropriately modified and implemented within the scope not deviating from the gist of the present invention.

[Aluminum Alloy Forging]

First, an aluminum alloy forging according to one embodiment of the present invention will be described.

An aluminum alloy forging according to this embodiment is formed of an aluminum alloy containing Cu: 0.15% by mass to 1.0% by mass, Mg: 0.6% by mass to 1.35% by mass, Si: 0.95% by mass to 1.45% by mass, Mn: 0.4% by mass to 0.6% by mass, Fe: 0.2% by mass to 0.7% by mass, Cr: 0.05% by mass to 0.35% by mass, Ti: 0.012% by mass to 0.035% by mass, B: 0.0001% by mass to 0.03% by mass, Zn: 0.25% by mass or less, Zr: 0.05% by mass or less, and a remainder consisting of Al and inevitable impurities, a crystal grain diameter in a part of the aluminum alloy forging where a maximum principal stress is applied to the part is 20 to 40 μm, the aluminum alloy forging has a structure in which an average shortest distance from a precipitate having a major axis of 0.1 μm or more to a crystal grain boundary in a cross-sectional structure with a visual field area of 8,000 $\mu m^2$ is in a range of 0.1 μm or more and 2.0 μm or less, and the aluminum alloy forging has fatigue characteristics in which a fatigue life at a load stress of 150 MPa is $6\times10^6$ or more at room temperature.

The aluminum alloy forging according to this embodiment corresponds to a forging of a 6000 series aluminum alloy in view of the fact that Mg and Si are contained.

(Cu: 0.15% by Mass or More and 1.0% by Mass or Less)

Cu acts to finely disperse an Mg—Si-based compound in an aluminum alloy, and to improve a tensile strength of the aluminum alloy by precipitating as an Al—Cu—Mg—Si-based compound including a Q phase. In a case where the Cu content is within the above range, the mechanical characteristics of the aluminum alloy forging at room temperature can be improved.

(Mg: 0.60% by Mass or More and 1.35% by Mass or Less)

Mg acts to improve a tensile strength of an aluminum alloy. Mg is solid-solubilized in an aluminum base phase, or precipitated as an Mg—Si-based compound ($Mg_2Si$) such as a β" phase or an Al—Cu—Mg—Si-based compound including a Q phase, thereby contributing to the strengthening of the aluminum alloy. In a case where the Mg content is within the above range, corrosion resistance can be improved as well as the mechanical characteristics of the aluminum alloy forging at room temperature.

(Si: 0.95% by Mass or More and 1.45% by Mass or Less)

As in the case of Mg, Si acts to improve corrosion resistance as well as the mechanical characteristics of the aluminum alloy forging at room temperature. However, in a case where Si is excessively added to an aluminum alloy, there is a concern that the tensile strength of the aluminum alloy may be reduced due to crystallization of coarse primary crystal Si grains. In a case where the Si content is within the above range, the crystallization of primary crystal Si can be suppressed, and corrosion resistance can be improved as well as the mechanical characteristics of the aluminum alloy forging at room temperature.

(Mn: 0.4% by Mass or More and 0.6% by Mass or Less)

Mn acts to improve a tensile strength of an aluminum alloy by forming fine granular crystallized products containing an intermetallic compound such as Al—Mn—Fe—Si and Al—Mn—Cr—Fe—Si in the aluminum alloy. In a case where the Mn content is within the above range, the mechanical characteristics of the aluminum alloy forging at room temperature can be improved.

(Fe: 0.2% by Mass or More and 0.7% by Mass or Less)

Fe acts to improve a tensile strength of an aluminum alloy by crystallizing as fine crystallized products containing an intermetallic compound such as Al—Mn—Fe—Si, Al—Mn—Cr—Fe—Si, Al—Fe—Si, Al—Cu—Fe, and Al—Mn—Fe in the aluminum alloy. In a case where the Fe content is within the above range, the mechanical characteristics of the aluminum alloy forging at room temperature can be improved.

(Cr: 0.05% by Mass or More and 0.35% by Mass or Less)

Cr acts to improve a tensile strength of an aluminum alloy by forming fine granular crystallized products containing an intermetallic compound such as Al—Mn—Cr—Fe—Si and Al—Fe—Cr in the aluminum alloy. In a case where the Cr content is within the above range, the mechanical characteristics of the aluminum alloy forging at room temperature can be improved.

(Ti: 0.012% by Mass or More and 0.035% by Mass or Less)

Ti acts to refine crystal grains of an aluminum alloy and improve extending workability. In a case where the Ti content is less than 0.012% by mass, there is a concern that a sufficient crystal grain refining effect may not be obtained. Meanwhile, in a case where the Ti content is more than 0.035% by mass, there is a concern that coarse crystallized products may be formed and the extending workability may be reduced. In addition, in a case where a large amount of coarse crystallized products containing Ti is mixed in the aluminum alloy forging, the toughness may be reduced. Therefore, the Ti content is 0.012% by mass or more and 0.035% by mass or less. The Ti content is preferably 0.015% by mass or more and 0.030% by mass or less.

(B: 0.0001% by Mass or More and 0.03% by Mass or Less)

B acts to refine crystal grains of an aluminum alloy and improve extending workability. In a case where B is added to the aluminum alloy together with Ti described above, the crystal grain refining effect is improved. In a case where the B content is less than 0.001% by mass, there is a concern that a sufficient crystal grain refining effect may not be obtained. Meanwhile, in a case where the B content is more than 0.03% by mass, there is a concern that coarse crystallized products may be formed and mixed in the aluminum alloy forging as inclusions. In addition, in a case where a large amount of coarse crystallized products containing B is mixed in a final product of the aluminum alloy, the toughness may be reduced. Therefore, the B content is 0.001% to 0.03% by mass. The B content is preferably 0.005% to 0.025% by mass.

(Zn: 0.25% by Mass or Less)

Zn contributes to the strength by solid solution strengthening in a case where the content thereof is 0.25% or less. However, in a case where the Zn content is 0.25% or more, $MgZn_2$ is precipitated in an Al base phase, and this leads to a reduction in corrosion resistance. Therefore, the Zn content is preferably 0.25% by mass or less.

(Zr: 0.05% by Mass or Less)

In a case where the Zr content is 0.05% by mass or less, Zr is precipitated in the form of $Al_3Zr$ and Al—(Ti, Zr), and thus contributes to the strength by a recrystallization suppression effect and precipitation strengthening. However, in a case where more than 0.05% by mass of Zr is added, Zr is crystallized as a coarse compound, and this leads to a reduction in strength. Therefore, the Zr content is preferably 0.05% by mass or less.

(Inevitable Impurities)

The inevitable impurities are impurities inevitably mixed in the aluminum alloy from the raw material or manufacturing process of the aluminum alloy forging. Examples of the inevitable impurities may include Ni, Sn, and Be. Preferably, the inevitable impurity content is not more than 0.1% by mass.

In the aluminum alloy forging according to this embodiment, a crystal grain diameter in a part where a maximum principal stress is applied is 20 to 40 μm, and the aluminum alloy forging has a structure in which an average shortest distance from a precipitate having a major axis of 0.1 μm or more to a crystal grain boundary in a cross-sectional structure with a visual field area of 8,000 $\mu m^2$ is in a range of 0.1 μm or more and 2.0 μm or less.

In a case where the crystal grain diameter is more than 40 μm, satisfactory tensile and fatigue characteristics cannot be obtained due to the Hall-Petch relationship. Meanwhile, in a case where the crystal grain diameter is less than 20 μm, the toughness worsens, and the impact properties are reduced. Therefore, it is necessary to control the crystal grain diameter in a range of 20 to 40 μm.

As a result, it is possible to obtain the aluminum alloy forging according to this embodiment having fatigue characteristics in which a fatigue life at a load stress of 150 MPa is $6\times10^6$ or more at room temperature. Meanwhile, in a case where a region where no compound is generated exceeds 2 μm, the crystal grain boundary weakens, and it is difficult to obtain a fatigue life of $6\times10^6$ or more at a load stress of 150 MPa.

[Manufacturing Method of Aluminum Alloy Forging]

Next, a manufacturing method of the aluminum alloy forging will be described.

A manufacturing method of the aluminum alloy forging according to this embodiment includes preparing a molten alloy having the same composition as the aluminum alloy forging, and casting the molten alloy at a cooling speed of 100 to 140° C./sec during casting so that a crystal grain diameter is 110 μm or less in a metallographic structure of an obtained cast rod.

In the manufacturing method of the aluminum alloy forging according to this embodiment, the aluminum alloy forging can be manufactured through, for example, a molten metal forming step, a casting step, a homogenization heat treatment step, a forging step, a solutionizing treatment step, a quenching treatment step, and an aging treatment step.

(Molten Metal Forming Step)

The molten metal forming step is a step of obtaining a molten aluminum alloy having a composition prepared by melting a raw material. The molten aluminum alloy has the same composition as the aluminum alloy forging. The molten aluminum alloy can be obtained by heating and melting an aluminum alloy. In addition, the molten aluminum alloy may be formed by melting a mixture containing a simple substance of an element that is a raw material of the aluminum alloy or a compound containing two or more elements at such a ratio as to produce the target aluminum alloy. For example, Ti and B may be mixed as a crystal grain refining material such as Al—Ti—B rods in order to control the crystal grain diameter of the aluminum alloy produced in the casting step.

(Casting Step)

In the casting step, the molten metal of the aluminum alloy (liquid phase) is cooled and solidified into a solid (solid phase), and an aluminum alloy casting is obtained. In the casting step, for example, a horizontal continuous casting method can be used.

Figure 2:
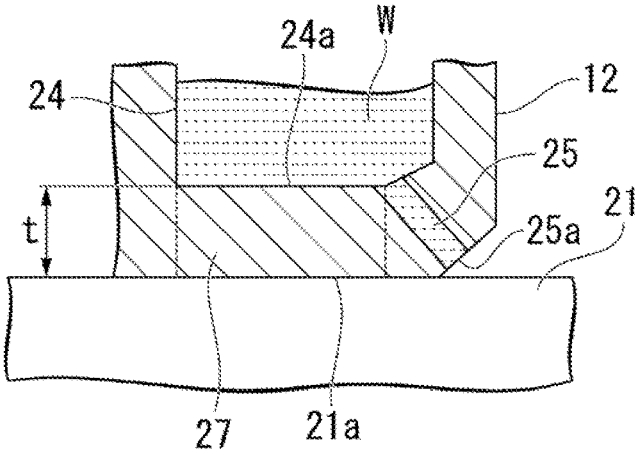
FIG. 2 is an enlarged cross-sectional view of a major part near a cooling water cavity of the horizontal continuous casting apparatus shown in FIG. 1.

Here, a horizontal continuous casting apparatus which can be used for manufacturing of the aluminum alloy casting according to this embodiment is shown in FIGS. 1 and 2.

FIG. 1 is a cross-sectional view showing an example of the vicinity of a mold 12 of a horizontal continuous casting apparatus 10. FIG. 2 is an enlarged cross-sectional view of a major part near a cooling water cavity 24 of the horizontal continuous casting apparatus 10.

The horizontal continuous casting apparatus 10 shown in FIGS. 1 and 2 has a molten metal receiving portion (tundish) 11, the mold 12 having a hollow cylindrical shape, and a refractory material-made plate-like body (heat insulating member) 13 placed between one end side 12*a* of the mold 12 and the molten metal receiving portion 11.

The molten metal receiving portion 11 is composed of a molten metal inflow portion 11*a* which receives a molten aluminum alloy M obtained in the molten metal forming step, a molten metal holding portion 11*b*, and an outflow portion 11*c* for outflow to a hollow portion 21 of the mold 12.

The molten metal receiving portion 11 maintains an upper liquid level of the molten aluminum alloy M at a position higher than an upper surface of the hollow portion 21 of the mold 12. In a case of multiple casting, the molten metal receiving portion 11 stably distributes the molten aluminum alloy M to each mold 12.

The molten aluminum alloy M held in the molten metal holding portion 11*b* in the molten metal receiving portion 11 is poured into the hollow portion 21 of the mold 12 from a pouring passage 13*a* provided in the refractory material-made plate-like body 13. Then, the molten aluminum alloy M supplied into the hollow portion 21 is cooled and solidified by a cooling device 23 to be described later, and is drawn out from the other end side 12*b* of the mold 12 as an aluminum alloy rod B, which is a solidified ingot.

A drawing drive device (not shown) which draws out the cast aluminum alloy rod B at a constant speed may be installed at the other end side 12*b* of the mold 12. In addition, it is also preferable to install a synchronous cutting machine (not shown) which cuts the continuously drawn aluminum alloy rod B into an arbitrary length.

The refractory material-made plate-like body 13 is a member which blocks heat transfer between the molten metal receiving portion 11 and the mold 12, and for example, may be made of a material such as calcium silicate, alumina, silica, a mixture of alumina and silica, silicon nitride, silicon carbide, or graphite. Such refractory material-made plate-like body 13 can also be formed of a plurality of layers of different constituent materials.

The mold 12 is a member having a hollow cylindrical shape in this embodiment, and is made of, for example, one or a combination of two or more selected from aluminum, copper, and alloys thereof. As the material of the mold 12, an optimum combination may be selected from the viewpoint of thermal conductive properties, heat resistance, and mechanical strength.

The hollow portion 21 of the mold 12 is formed to have a circular cross-section in order to form an aluminum alloy rod B to be cast into a cylindrical rod shape, and the mold 12 is held so that a mold center axis (center axis) C passing through the center of the hollow portion 21 substantially goes along the horizontal direction.

An inner peripheral surface 21*a* of the hollow portion 21 of the mold 12 is formed with an elevation angle of 0° to 3° (more preferably 0° to) 1° with respect to the mold center axis C toward the casting direction of the aluminum alloy rod B (see FIG. 1). That is, the inner peripheral surface 21*a* is configured into a tapered shape which is opened in a cone shape toward the casting direction. The angle formed by the taper is the elevation angle.

In a case where the elevation angle is less than 0°, the aluminum alloy rod B meets a resistance at the other end side 12*b*, which is a mold outlet, when being drawn out from the mold 12. Therefore, there is a concern that there may be difficulty in casting. Meanwhile, in a case where the elevation angle is more than 3°, the contact of the inner peripheral surface 21*a* with the molten aluminum alloy M is insufficient, and the effect of releasing heat from the molten aluminum alloy M or the solidified shell formed by cooling and solidifying the molten aluminum alloy M to the mold 12 is reduced. Thus, there is a concern that the solidification may insufficiently occur. As a result, there is a concern that casting troubles may occur, such as the generation of remelted skin on a surface of the aluminum alloy rod B, or a spurt of the unsolidified molten aluminum alloy M from an end portion of the aluminum alloy rod B, which is not preferable.

In addition, the cross-sectional shape of the hollow portion 21 of the mold 12 (the planar shape when the hollow portion 21 of the mold 12 is viewed from the other end side 21*b*) may be a shape selected according to the shape of an aluminum alloy rod to be cast from, for example, a triangular or rectangular cross-sectional shape, a polygonal shape, a semicircular shape, an elliptical shape, a shape having a modified cross-sectional shape having no axis of symmetry or plane of symmetry, and the like, other than the circular shape of this embodiment.

A fluid supply pipe 22 which supplies a lubricating fluid into the hollow portion 21 of the mold 12 is placed at the one end side 12*a* of the mold 12. As the lubricating fluid supplied from the fluid supply pipe 22, any one or two or more kinds of lubricating fluids selected from gas lubricating materials and liquid lubricating materials can be used. In a case where both the gas lubricating material and the liquid lubricating material are supplied, it is preferable to provide separate fluid supply pipes for the above lubricating materials. The lubricating fluid supplied under pressure from the fluid supply pipe 22 is supplied into the hollow portion 21 of the mold 12 through a circular lubricating material supply port 22*a*.

In this embodiment, the lubricating fluid fed forcibly is supplied from the lubricating material supply port 22*a* to the inner peripheral surface 21*a* of the mold 12. A configuration may be employed in which the liquid lubricating material is heated and converted into a decomposed gas and the gas is supplied to the inner peripheral surface 21*a* of the mold 12. In addition, a configuration may be employed in which a porous material is placed at the lubricating material supply port 22*a* to ooze out the lubricating fluid to the inner peripheral surface 21*a* of the mold 12 via the porous material.

The cooling device 23, which is cooling means for cooling and solidifying the molten aluminum alloy M, is formed inside the mold 12. The cooling device 23 according to this embodiment has a cooling water cavity 24 which accommodates cooling water W for cooling the inner peripheral surface 21*a* of the hollow portion 21 of the mold 12, and a cooling water injection passage 25 which communicates the cooling water cavity 24 with the hollow portion 21 of the mold 12.

The cooling water cavity 24 is formed to have a circular shape so as to surround the hollow portion 21 outside the inner peripheral surface 21*a* of the hollow portion 21 inside the mold 12, and is supplied with the cooling water W via a cooling water supply pipe 26.

The inner peripheral surface 21*a* of the mold 12 is cooled by the cooling water W accommodated in the cooling water cavity 24, so that the heat of the molten aluminum alloy M filling the hollow portion 21 of the mold 12 is drawn from the surface which is in contact with the inner peripheral surface 21*a* of the mold 12, and a solidified shell is formed on the surface of the molten aluminum alloy M.

The cooling water injection passage 25 cools the aluminum alloy rod B by directly applying the cooling water W toward the aluminum alloy rod B at the other end side 12*b* of the mold 12 from a shower opening 25*a* facing the hollow portion 21. The longitudinal cross-sectional shape of the cooling water injection passage 25 may be, for example, a semicircular shape, a pear shape, or a horseshoe shape, other than the circular shape of this embodiment.

In this embodiment, the cooling water W supplied via the cooling water supply pipe 26 is first accommodated in the cooling water cavity 24 to cool the inner peripheral surface 21*a* of the hollow portion 21 of the mold 12, and the cooling water W in the cooling water cavity 24 is injected from the cooling water injection passage 25 toward the aluminum alloy rod B. However, a configuration may be employed in which the above supply operations are performed with separate cooling water supply pipes.

The length from a position where an extension of a center axis of the shower opening 25*a* of the cooling water injection passage 25 hits the surface of the cast aluminum alloy rod B to a contact surface between the mold 12 and the refractory material-made plate-like body 13 is called an effective mold length L, and the effective mold length L is, for example, preferably 10 mm or more and 40 mm or less. In a case where the effective mold length L is less than 10 mm, no good film is formed, and thus casting is not possible. In a case where the effective mold length L is more than 40 mm, the forced cooling effect is reduced, and solidification by the mold wall becomes dominant. Therefore, the contact resistance between the mold 12 and the molten aluminum alloy M or the aluminum alloy rod B increases, and thus there is a concern that unstable casting, such as cracks occurring on the cast skin or tearing inside the mold, may occur. Thus, it is not preferable that the effective mold length L is less than 10 mm or more than 40 mm.

It is preferable that each of the supply of the cooling water W to the cooling water cavity 24 and the injection of the cooling water W from the shower opening 25*a* of the cooling water injection passage 25 can be controlled by a control signal from a control device (not shown).

The cooling water cavity 24 is formed so that an inner bottom surface 24*a* near the hollow portion 21 of the mold 12 and the inner peripheral surface 21*a* of the hollow portion 21 of the mold 12 are parallel to each other.

The term "parallel" mentioned here also includes a case where the inner peripheral surface 21*a* of the hollow portion 21 of the mold 12 is formed with an elevation angle of 0° to 3° with respect to the inner bottom surface 24*a* of the cooling water cavity 24, that is, a case where the inner bottom surface 24*a* is inclined with respect to the inner peripheral surface 21*a* at an angle of more than 0° to 3°.

As shown in FIG. 2, a cooling wall portion 27 of the mold 12, which is a part where the inner bottom surface 24*a* of the cooling water cavity 24 and the inner peripheral surface 21*a* of the hollow portion 21 of the mold 12 face each other, is formed so that the value of heat flux per unit area from the molten aluminum alloy M of the hollow portion 21 toward the cooling water W of the cooling water cavity 24 is within a range of $10\times10^5$ W/m$^2$ or more and $50\times10^5$ W/m$^2$ or less.

The mold 12 may be formed so that a thickness t of the cooling wall portion 27 of the mold 12, that is, the distance between the inner bottom surface 24*a* of the cooling water cavity 24 and the inner peripheral surface 21*a* of the hollow portion 21 of the mold 12 is, for example, within a range of 0.5 mm or more and 3.0 mm or less, and preferably 0.5 mm or more and 2.5 mm or less. In addition, the material for forming the mold 12 may be selected so that at least the cooling wall portion 27 of the mold 12 has a thermal conductivity within the range of 100 W/m·K or more and 400 W/m·K or less.

In FIG. 2, the molten aluminum alloy M in the molten metal receiving portion 11 is supplied from the one end side 12*a* of the mold 12 held so that the mold center axis C is substantially horizontal through the refractory material-made plate-like body 13, and is forcibly cooled at the other end side 12*b* of the mold 12 to form the aluminum alloy rod B.

The aluminum alloy rod B is drawn out at a constant speed by a drawing drive device (not shown) installed near the other end side 12*b* of the mold 12. Accordingly, a long aluminum alloy rod B is formed by continuous casting. The drawn aluminum alloy rod B is cut into a desired length by, for example, a synchronous cutting machine (not shown).

The composition ratio of the cast aluminum alloy rod B can be confirmed by, for example, a method using a photoelectric photometry type emission spectrophotometer (device example: PDA-5500 manufactured by Shimadzu Corporation, Japan) as described in "JIS H 1305".

The height difference between the liquid level of the molten aluminum alloy M stored in the molten metal receiving portion 11 and the inner peripheral surface 21*a* on the upper side of the mold 12 is preferably 0 mm to 250 mm (more preferably 50 mm to 170 mm). In a case where the height difference is within such a range, the pressure of the molten aluminum alloy M supplied into the mold 12 is well balanced with the lubricating oil and the gas generated by vaporization of the lubricating oil, and thus castability is stabilized.

Vegetable oil, which is a lubricating oil, can be used as the liquid lubricating material. Examples thereof include rapeseed oil, castor oil, and salad oil. These are preferable since these have little adverse effect on the environment.

The lubricating oil supply rate is preferably 0.05 mL/min to 5 mL/min (more preferably 0.1 mL/min or more and 1 mL/min or less). In a case where the supply rate is too low, there is a concern that the molten aluminum alloy M of the aluminum alloy rod B may not solidify and leak from the mold 12 due to insufficient lubrication. In a case where the supply rate is too high, there is a concern that the surplus may be mixed in the aluminum alloy rod B and cause internal defects.

The casting speed, which is a speed at which the aluminum alloy rod B is drawn out from the mold 12, is preferably 200 mm/min or more and 1,500 mm/min or less (more preferably 400 mm/min or more and 1000 mm/min or less). The reason for this is that in a case where the casting speed is within this range, the crystallized products formed by casting have a uniform and fine network structure, and thus the resistance to deformation of the aluminum material at high temperatures increases, and the high-temperature mechanical strength is improved.

The amount of the cooling water injected from the shower opening 25*a* of the cooling water injection passage 25 is preferably 10 L/min or more and 50 L/min or less (more preferably 25 L/min or more and 40 L/min or less) per mold. In a case where the amount of the cooling water is less than the above range, there is a concern that the molten aluminum alloy M may leak from the mold 12 without solidifying. In addition, there is a concern that a non-uniform structure may be formed due to remelting of the surface of the cast aluminum alloy rod B and may remain as internal defects. Meanwhile, in a case where the amount of the cooling water is more than this range, there is a concern that solidification may occur in the middle of the operation due to excessive heat release of the mold 12.

The average temperature of the molten aluminum alloy M flowing into the mold 12 from the inside of the molten metal receiving portion 11 is, for example, preferably 650° C. or higher and 750° C. or lower (more preferably 680° C. or higher and 720° C. or lower). In a case where the temperature of the molten aluminum alloy M is too low, there is a concern that coarse crystallized products may be formed in and in front of the mold 12, and may be taken into the aluminum alloy rod B as internal defects. Meanwhile, in a case where the temperature of the molten aluminum alloy M is too high, there is a concern that a large amount of hydrogen gas is likely to be taken into the molten aluminum alloy M, and may be taken into the aluminum alloy rod B as porosity, resulting in internal cavities.

In addition, in the cooling wall portion 27 of the mold 12, in a case where the value of heat flux per unit area from the molten aluminum alloy M of the hollow portion 21 toward the cooling water W of the cooling water cavity 24 is within a range of $10\times10^5$ W/m$^2$ or more and $50\times10^5$ W/m$^2$ or less, it is possible to prevent the occurrence of seizure of the aluminum alloy rod B.

Figure 3:
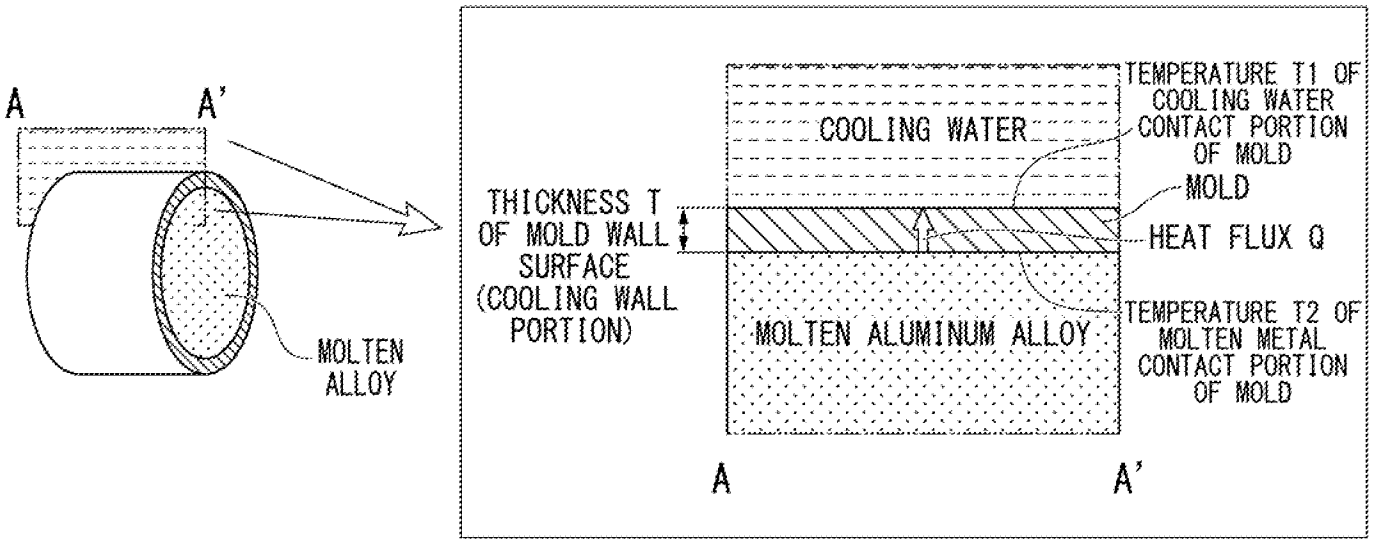
FIG. 3 is an explanatory drawing explaining a heat flux of a cooling wall portion of the horizontal continuous casting apparatus.

The cooling wall portion 27 of the mold 12 receives heat due to heat release from the molten aluminum alloy M, and cools the heat by the cooling water W accommodated in the cooling water cavity 24 to perform heat exchange. Regarding the state of heat exchange, attention was focused on the heat flux per unit area as in the explanatory drawing shown in FIG. 3. The heat flux per unit area is represented by Formula (1) according to the Fourier's law.

$$Q = -k \times (T1 - T2)/L \quad (1)$$

Q: Heat Flux k: A thermal conductivity (W/m·K) of a place through which heat passes (in this embodiment, the cooling wall portion 27 of the mold 12)

T1: A low temperature-side temperature of a place through which heat passes (in this embodiment, the inner bottom surface 24*a* of the cooling water cavity 24)

T2: A high temperature-side temperature of a place through which heat passes (in this embodiment, the inner peripheral surface 21*a* of the hollow portion 21 of the mold 12)

L: A section length (mm) of a place through which heat passes (in this embodiment, the thickness t of the cooling wall portion 27 of the mold 12)

In a case where, based on the mold material, thickness, and temperature measurement data that produce good results even with a reduction in amount of the lubricating oil during casting, the cooling wall portion 27 of the mold 12 is configured so that the value of heat flux per unit area is $10\times10^5$ W/m$^2$ or more, it is possible to prevent seizure of the cast aluminum alloy rod B. In addition, the value of heat flux per unit area is preferably $50\times10^5$ W/m$^2$ or less.

In order to adjust the value of heat flux within the above range in the cooling wall portion 27 of the mold 12, the mold 12 may be formed so that the thickness t of the cooling wall portion 27 of the mold 12 is, for example, in a range of 0.5 mm or more and 3.0 mm or less. In addition, the thermal conductivity of at least the cooling wall portion 27 of the mold 12 may be in a range of 100 W/m·K or more and 400 W/m·K or less.

In manufacturing of the aluminum alloy rod B according to this embodiment, the molten aluminum alloy M stored in the molten metal receiving portion 11 is continuously supplied into the hollow portion 21 from the one end side 12*a* of the mold 12 by using the above-described horizontal continuous casting apparatus 10. In addition, the cooling water W is supplied to the cooling water cavity 24, and the lubricating fluid such as lubricating oil is supplied from the fluid supply pipe 22.

In addition, the molten aluminum alloy M supplied into the hollow portion 21 is cooled and solidified under the condition that the value of heat flux per unit area in the cooling wall portion 27 is $10\times10^5$ W/m$^2$ or more, and the aluminum alloy rod B is cast. In addition, during casting of the aluminum alloy rod B, the wall surface temperature of the cooling wall portion 27 of the mold 12 cooled by the cooling water W is preferably 100° C. or lower.

The aluminum alloy rod B obtained as above is cooled and solidified under the condition that the value of heat flux per unit area in the cooling wall portion 27 is $10\times10^5$ W/m$^2$ or more, and thus adhesion of reaction products, such as carbides, formed due to the contact between the gas of the lubricating oil and the molten aluminum alloy M is suppressed. Accordingly, it is not necessary to remove the carbides and the like on the surface of the aluminum alloy rod B by cutting, and the aluminum alloy rods B can be manufactured at a high yield.

The casting step of obtaining a casting from the molten aluminum alloy M is not limited to the above-described horizontal continuous casting method, and a known continuous casting method such as a vertical continuous casting method can be used. The vertical continuous casting method is classified into a float method and a hot top method depending on the method of supplying the molten aluminum alloy M to the mold (mold 12). A case using the hot top method will be briefly described below.

A casting apparatus used in the hot top method includes a mold, a molten metal receptor (header), and the like. The molten metal supplied to the molten metal receiving portion passes through the outlet port and the header, and the flow rate thereof is adjusted. The molten metal is put into a cylindrical mold installed substantially horizontally, and forcibly cooled therein. Therefore, a solidified shell is formed on the outer surface of the molten metal.

Furthermore, cooling water is directly applied to the casting drawn out from the mold, and the casting is continuously drawn out while solidification of the metal progresses to the inside of the casting. In general, a metal member having good thermal conductive properties is used for the mold, and the mold has a hollow structure for introducing a refrigerant therein.

The refrigerant to be used may be appropriately selected from industrially available refrigerants, but water is recommended from the viewpoint of ease of use.

The mold used in this embodiment is appropriately selected from metals such as copper and aluminum, and graphite from the viewpoint of heat transfer performance and durability at the contact portion with the molten metal. The header, generally made of a refractory material, is installed on the upper side of the mold. The material and size of the header may be appropriately selected according to the composition range of the alloy to be cast and the dimensions of the casting, and are not particularly limited.

The average cooling speed during casting may be appropriately selected from a generally recommended range such as 10 to 300° C./sec. The casting speed may be appropriately selected from a general range in horizontal continuous casting. For example, the casting speed may be appropriately selected from a range of 200 to 600 mm/min.

By the casting method described above, it is possible to obtain a uniform metallographic structure even in medium- to large-sized castings. The diameter of a target casting is not particularly limited, and rods having a diameter of 30 to 100 mm are preferably used.

(Homogenization Heat Treatment Step)

The homogenization heat treatment step is a step in which the aluminum alloy casting obtained in the casting step is subjected to a homogenization heat treatment to homogenize the microsegregation caused by solidification, precipitate the supersaturated solid solution element, and convert the metastable phase to the equilibrium phase.

In this embodiment, the aluminum alloy casting obtained in the casting step is subjected to a homogenization heat treatment for holding the casting at a temperature of 370° C. or higher and 560° C. or lower for 4 to 10 hours. In a case where the homogenization heat treatment is performed within this temperature range, the homogenization of the aluminum alloy casting and the incorporation of the solute atom are performed sufficiently. Therefore, a necessary and sufficient strength is obtained by the subsequent aging treatment.

(Forging Step)

The forging step is a step in which a forging material is obtained by forming the aluminum alloy casting after the homogenization heat treatment step into a predetermined size, and the obtained forging material is heated at a predetermined temperature, and then subjected to die and punch forming by applying a pressure with a press machine.

In this embodiment, the forging material is forged at a heating temperature of 450° C. or higher and 560° C. or lower to obtain a forging (for example, an automobile suspension arm component). In this case, the temperature at which the forging of the forging material is started is preferably 450° C. or higher and 560° C. or lower. In a case where the start temperature is lower than 450° C., there is a concern that the deformation resistance may increase and sufficient working may not be performed. Meanwhile, in a case where the start temperature is higher than 560° C., there is a concern that defects such as forging cracks and eutectic melting are likely to occur.

(Solutionizing Treatment Step)

The solutionizing treatment step is a step in which the forging obtained in the forging step is solutionized by heating to relax the distortion introduced in the casting and solid-solubilize the solute element.

In this embodiment, the solutionizing treatment is performed by holding the forging at a treatment temperature of 530° C. or higher and 560° C. or lower for 0.3 hours or longer and 3 hours or shorter. The rate of temperature increase from the room temperature to the treatment temperature described above is preferably 5.0° C./min or more. In a case where the treatment temperature is lower than 530° C., there is a concern that the solute element may be insufficiently solid-solubilized. Meanwhile, in a case where the temperature is higher than 560° C., there is a concern that although solid-solubilizing of the solute element is further promoted, eutectic melting and recrystallization are likely to occur. In addition, in a case where the rate of temperature increase is less than 5.0° C./min, there is a concern that $Mg_2Si$ may be coarsely precipitated. Meanwhile, in a case where the treatment temperature is lower than 530° C., there is a concern that solutionizing may not proceed, and it may become difficult to realize an increase of the strength by aging precipitation.

(Quenching Treatment Step)

The quenching treatment step is a step in which the forging in a solid-solubilized state, obtained by the solutionizing treatment step, is rapidly cooled to form a supersaturated solid solution.

In this embodiment, the forging is put into a water tank storing water (quenching water), and submerged to be subjected to the quenching treatment. The water temperature in the water tank is preferably 20° C. or higher and 60° C. or lower. It is preferable that the forging is put into the water tank so that the entire surface of the forging is brought into contact with the water for 5 seconds or longer and 60 seconds or shorter after the solutionizing treatment. The submersion time of the forging varies according to the size of the casting, but is, for example, longer than 5 minutes and shorter than 40 minutes.

(Aging Treatment Step)

The aging treatment step is a step in which the forging is heated and held at a relatively low temperature to precipitate the element solid-solubilized in a supersaturated state, and appropriate hardness is thus imparted.

In this embodiment, the forging after the quenching treatment step is heated at a temperature of 170° C. or higher and 220° C. or lower, and is held at that temperature for 0.5 hours or longer and 7.0 hours or shorter to perform the aging treatment. In a case where the heating temperature is lower than 180° C. or the holding time is shorter than 0.5 hours, there is a concern that a $Mg_2Si$-based precipitate which improves a tensile strength cannot be sufficiently grown. Meanwhile, in a case where the treatment temperature is higher than 220° C., there is a concern that the $Mg_2Si$-based precipitate may become too coarse, and thus the tensile strength cannot be sufficiently improved.

EXAMPLES

Hereinafter, the effects of the present invention will be described in greater detail with reference to Examples. The present invention is not limited to the following Examples, and can be appropriately modified and implemented within a scope not departing from the gist thereof.

Examples 1 to 3 and Comparative Example 1

First, aluminum alloys having an alloy composition shown in Table 1 below were prepared. Using the prepared aluminum alloys, continuously cast products having a circular cross-section with a diameter of 49 mm were produced.

TABLE 1

| | Element Content (% by mass) | | | | | | | | | |
|---|---|---|---|---|---|---|---|---|---|---|
| | Cu | Mg | Si | Mn | Fe | Cr | Ti | B | Zn | Zr |
| Example 1 | 0.3145 | 0.9034 | 1.1060 | 0.4370 | 0.3084 | 0.0961 | 0.0200 | 0.0012 | 0.0100 | 0.0100 |
| Example 2 | 0.3100 | 0.8900 | 1.1320 | 0.4340 | 0.2710 | 0.0970 | 0.0160 | 0.0010 | 0.0100 | 0.0100 |
| Example 3 | 0.3220 | 0.8920 | 1.1120 | 0.4240 | 0.4820 | 0.0950 | 0.0160 | 0.0011 | 0.0100 | 0.0100 |
| Comparative Example 1 | 0.3000 | 0.9380 | 1.1120 | 0.4240 | 0.2950 | 0.0970 | 0.0160 | 0.0013 | 0.0100 | 0.0100 |

Figure 4:
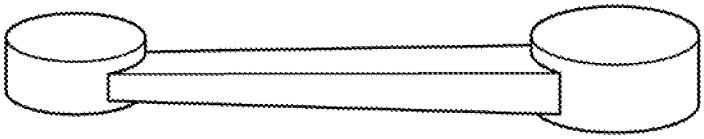
FIG. 4 is a perspective view of an aluminum alloy forging produced in Examples.

Next, the obtained continuously cast products were subjected to a homogenization heat treatment, forging, a solutionizing treatment, a quenching treatment, and an artificial aging treatment in this order to obtain aluminum alloy forgings having a shape shown in FIG. 4. Table 2 below shows the conditions for the homogenization heat treatment, forging, solutionizing treatment, quenching treatment, and artificial aging treatment.

TABLE 2

| Steps | Conditions | |
|---|---|---|
| Homogenization Heat Treatment | Rate of Temperature Increase [° C./min] | 1.5 |
| | Temperature [° C.] | 470 |
| | Holding Time [min] | 420 |
| Forging | Temperature [° C.] | 520 |
| Solutionizing Treatment | Rate of Temperature Increase [° C./min] | 10 |
| | Temperature [° C.] | 545 |
| | Holding Time [min] | 180 |
| Quenching Treatment | Time Until Forged Product is Submerged [s] | 15 |
| | Water Temperature [° C.] | 60 |
| | Submersion Time [min] | 6 |
| Artificial Aging Treatment | Temperature [° C.] | 180 |
| | Holding Time [min] | 300 |

<Evaluation>

The aluminum alloy forgings of Examples 1 to 3 and Comparative Example 1 obtained as described above were evaluated according to the following evaluation methods. The results are shown in Table 3 below.

mm was collected. A load stress of 150 MPa was applied to the obtained fatigue test piece to perform a rotary bending fatigue test at room temperature (25° C.), and a fatigue life was measured. The obtained fatigue life was evaluated based on the following judgement criteria.

<Judgement Criteria>

"O" . . . The fatigue life at room temperature and at a load stress of 150 MPa is $6\times10^6$ or more "X" . . . The fatigue life at room temperature and at a load stress of 150 MPa is less than $6\times10^6$ "Method of Measuring Crystal Grain Diameter of Aluminum Forging"

The crystal grain diameter was measured using an SEM-EBSD device for each of the aluminum alloy forgings of Examples 1 to 3 and Comparative Example 1. A plate-like body of 7 mm×7 mm×3 mm thick was collected from the forging and used as a SEM-EBSD measurement sample. The measurement was performed under measurement conditions of an acceleration voltage of 15 kV, a measurement pitch of 0.5 μm/px, an analysis region of 500×500 $\mu m^2$, and a grain boundary definition angle of 15°. The results are shown in Table 3 above.

"Method of Measuring Distance in which No Compound is Generated in Region Including Grain Boundary in Aluminum Alloy Forging"

Figure 5:
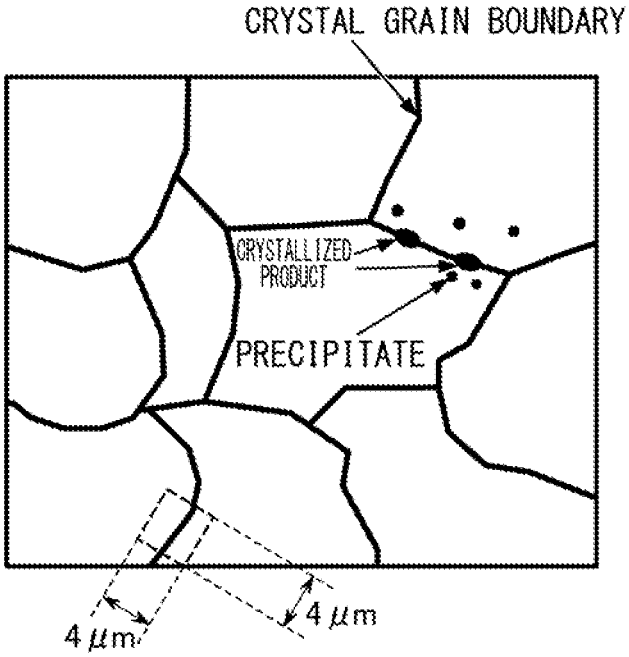
FIG. 5 is a schematic diagram for explaining the measurement of a distance in which no compound is generated in a region including a grain boundary in the aluminum alloy forging.

As shown in FIG. 5, for each of the aluminum alloy forgings of Examples 1 to 3 and Comparative Example 1, a shortest distance from a precipitate having a major axis of

TABLE 3

| | Fatigue Characteristics | | Crystal Grain Diameter | | | | | | | | | |
|---|---|---|---|---|---|---|---|---|---|---|---|---|
| | Fatigue Life at Load | | After Casting | | | | | After Forging | | | | |
| Examples/ Comparative Example | Stress of 150 MPa [cycle] | Evaluation 6.E+06 or more | Average | Maximum | Minimum | Standard Deviation | Evaluation 110 μm or less | Average | Maximum | Minimum | Standard Deviation | Evaluation 20 to 40 μm |
| Example 1 | 1.E+07 | ○ | 58.1 | 72.8 | 48.5 | 7.7 | ○ | 24.6 | 202.0 | 3.5 | 27.4 | ○ |
| Example 2 | 8.E+06 | ○ | 84.0 | 119.3 | 69.6 | 11.6 | ○ | 29.5 | 213.0 | 3.6 | 32.4 | ○ |
| Example 3 | 8.E+06 | ○ | 61.0 | 90.3 | 41.6 | 13.9 | ○ | 30.2 | 217.1 | 3.6 | 28.3 | ○ |
| Comparative Example 1 | 5.E+06 | X | 147.8 | 236.8 | 99.4 | 34.3 | X | 52.3 | 439.2 | 5.3 | 85.2 | X |

| | Metallographic Structure | | | Cooling Speed During Casting | | |
|---|---|---|---|---|---|---|
| Examples/ Comparative Example | Distance in Which No Compound is Generated in Region Including Crystal Grain Boundary | Evaluation 2.0 μm or less | Number of AlMnFeSi Compounds Existing in 4 μm Centered About Crystal Grain Boundary × 4 μm in Parallel to Crystal Grain Boundary [number] | Cooling Speed [° C./sec] | Evaluation 100 to 140° C./sec | Comprehensive Evaluation |
| Example 1 | 1.56 | ○ | 32 | 112.52 | ○ | ○ |
| Example 2 | 1.62 | ○ | 29 | 134.35 | ○ | ○ |
| Example 3 | 1.71 | ○ | 25 | 134.35 | ○ | ○ |
| Comparative Example 1 | 2.49 | X | 0 | 156.54 | X | X |

"Method of Evaluating Fatigue Characteristics at Room Temperature"

From each of the aluminum forgings of Examples 1 to 3 and Comparative Example 1, a fatigue test piece with a gauge length of 30 mm and a parallel portion diameter of 8

0.1 μm or more to a crystal grain boundary in a cross-sectional structure with a visual field area of 8,000 $\mu m^2$ was measured using an FE-SEM device.

A sample piece for structure observation having a size of 7 mm long×7 mm wide×3 mm thick was cut out from each aluminum alloy forging. This sample piece was polished using a cross-section sample preparing device (cross section polisher).

In the sample piece for structure observation after polishing, a cross-sectional structure of a region with a visual field area of 8,000 $\mu m^2$ (100 μm wide×80 μm long) was photographed using the FE-SEM. Next, the region where the FE-SEM photograph was taken was subjected to line analysis of elements by EDS to qualitatively analyze the compound present in the region.

From the obtained FE-SEM photograph and the results of the elemental analysis by EDS, a precipitate having a major axis of 0.1 μm or more was extracted, the distance between the precipitate and the crystal grain boundary was measured, and the shortest distance from the precipitate to the crystal grain boundary was measured. The shortest distance from the precipitate to the crystal grain boundary was measured at eight places, and the average of the measured values was defined as the average shortest distance from the precipitate to the crystal grain boundary.

Here, the precipitate includes, for example, a Mg—Si-based compound ($Mg_2Si$), an Al—Cu—Mg—Si-based compound (AlCuMgSi), Al—Mn—Fe—Si, Al—Mn—Cr—Fe—Si, Al—Cu—Fe, Al—Mn—Fe, Al—Cr—Si, $Al_3Zr$, Al—(Ti, Zr), and $CuAl_2$.

A case where the average shortest distance from the precipitate to the crystal grain boundary was within a range of 0.1 μm or more and 2.0 μm or less was represented by "O", and a case where the average shortest distance from the precipitate to the crystal grain boundary was less than 0.1 μm or more than 2.0 μm was represented by "X". The results are shown in Table 3 above.

As shown in Table 3, in Examples 1 to 3, the average shortest distance from the precipitate to the crystal grain boundary was within a range of 0.1 μm or more and 2.0 μm or less. In contrast, in Comparative Example 1, the average shortest distance from the precipitate to the crystal grain boundary was less than 0.1 μm or more than 2.0 μm.

<Comprehensive Evaluation>

The results of three evaluations, that is, the fatigue characteristics at room temperature, the crystal grain diameter, and the width of the region where no compound was generated in the region including the grain boundary, were evaluated based on the following judgement criteria.

(Judgement Criteria)

"O" . . . "O" in all the three evaluations

"X" . . . "X" in one or more of the three evaluations

"Method of Measuring Cooling Speed During Casting"

DAS was measured in the vicinity of the center of the φ49 cast rod to calculate the cooling speed during casting using a conversion expression. In addition, the DAS was measured according to a secondary branch method. The secondary branch method is applied to a structure in which secondary arms of dendrites develop, and a relatively large number of dendrites with an array of arms are shown, and where no obstruction is caused in measuring the arm spacing.

The DAS is measured on a circular cross-section obtained by cutting the aluminum alloy material obtained by the above-described method in a direction perpendicular to the casting direction. As a pretreatment for the surface to be measured, emery paper polishing, diamond paste polishing, and buffing with a colloidal silica suspension were performed in order to perform mirror finish, and Barker etching was further performed to reveal the crystal grain boundary. The observation was performed with an optical microscope at a magnification of 100 times, and a place where dendrites were clearly observed was defined as a measurement target.

Here, in a region from a surface layer of the ingot obtained in the continuous casting method to about 10 mm away therefrom, a solidification structure different from the central equiaxed crystal region is formed since a solidified shell is formed due to rapid cooling of the molten metal flowing into the mold. As a general tendency, a structure suitable for the DAS measurement by the secondary branch method described above cannot be obtained at a position from the outermost surface of the ingot to 5 mm away therefrom.

Therefore, as shown in FIG. 1, the DAS measurement was performed in each of three divided regions, that is, the region from 5 mm to 10 mm away from the upper end, the center portion of the ingot, and the region from 5 mm to 10 mm away from the lower end of the mold, except for the range from the upper end of the mold to a position 5 mm away therefrom and the range from the lower end of the mold to a position 5 mm away therefrom.

The visual field targeted for the DAS measurement included three crystal grains in which three or more secondary arms were clearly observed. As shown in Expression (2), a line segment linking boundaries was drawn from the boundary of the arm array group, and a line segment length $l_i$ was divided by a number calculated by subtracting the number m of arms from the number $n_i$ of intersections between the line segment and each arm to calculate the DAS.

$$DAS = \frac{\sum_i l_i}{\sum_i n_i - m} \tag{2}$$

The DAS was measured in three visual fields selected randomly for each region. The DAS measurement was performed at a total of 9 positions in one sample. After that, the cooling speed shown in Expression (3) was calculated using the following conversion expression (R: cooling speed) associated with the cooling speed during casting.

$$DAS = 85R^{-0.38} \tag{3}$$

From the results shown in Table 3, it has been confirmed that the aluminum alloy forgings of Examples 1 to 3 in which the composition of the alloy is within the range of the present invention, and the crystal grain diameter and the width of the region where no compound is generated in the region including the crystal grain boundary are within the range of the present invention have excellent fatigue characteristics. In contrast, it has been found that the aluminum alloy forging of Comparative Example 1 in which the crystal grain diameter and the width of the region where no compound is generated in the region including the grain boundary exceed the range of the present invention has deteriorated fatigue characteristics.

REFERENCE SIGNS LIST

10: Horizontal continuous casting apparatus
11: Molten metal receiving portion
12: Mold
13: Refractory plate-like body (heat insulating member)
21: Hollow portion
22: Fluid supply pipe
23: Cooling device
24: Cooling water cavity

25: Cooling water injection passage
26: Cooling water supply pipe
M: Molten aluminum alloy
S: Aluminum alloy rod

What is claimed is:

1. A method for manufacturing an aluminum alloy forging, comprising:

a molten metal forming step of preparing a molten alloy;

a casting step of casting the molten alloy at a cooling speed of 100 to 140° C./sec during casting to obtain a cast aluminum alloy rod; and a homogenization heat treatment step of subjecting the cast aluminum alloy rod obtained in the casting step to a homogenization heat treatment at a temperature of 370° C. or higher and 470° C. or lower for 4 to 10 hours so that a crystal grain diameter is 110 μm or less in a metallographic structure of an obtained cast rod, wherein the molten alloy comprises:

Cu: 0.15% by mass to 1.0% by mass;
Mg: 0.6% by mass to 1.35% by mass;
Si: 0.95% by mass to 1.45% by mass;
Mn: 0.4% by mass to 0.6% by mass;
Fe: 0.2% by mass to 0.7% by mass;
Cr: 0.05% by mass to 0.35% by mass;
Ti: 0.012% by mass to 0.035% by mass;
B: 0.0001% by mass to 0.03% by mass;
Zn: 0.25% by mass or less;
Zr: 0.05% by mass or less; and
a remainder consisting of Al and inevitable impurities, a crystal grain diameter in a part of the aluminum alloy forging where a maximum principal stress is applied to the part is 20 to 40 μm, the manufactured aluminum alloy forging has a structure in which an average shortest distance from a precipitate having a major axis of 0.1 μm or more to a crystal grain boundary in a cross-sectional structure with a visual field area of 8,000 $\mu m^2$ is in a range of 0.1 μm or more and 2.0 μm or less, and the manufactured aluminum alloy forging has fatigue characteristics in which a fatigue life at a load stress of 150 MPa is $6\times10^6$ or more at room temperature.

* * * * *